US010945507B2

(12) United States Patent
Mims

(10) Patent No.: US 10,945,507 B2
(45) Date of Patent: Mar. 16, 2021

(54) METHOD AND APPARATUS FOR MIXING BEAUTY PRODUCTS

(71) Applicant: Cecelia Ann Mims, Denver, CO (US)

(72) Inventor: Cecelia Ann Mims, Denver, CO (US)

( * ) Notice: Subject to any disclaimer, the term of this patent is extended or adjusted under 35 U.S.C. 154(b) by 0 days.

(21) Appl. No.: 16/433,676

(22) Filed: Jun. 6, 2019

(65) Prior Publication Data

US 2020/0029674 A1 Jan. 30, 2020

Related U.S. Application Data

(60) Provisional application No. 62/703,598, filed on Jul. 26, 2018.

(51) Int. Cl.

*A45D 34/00* (2006.01)
*B65D 83/68* (2006.01)
*B65D 83/62* (2006.01)

(52) U.S. Cl.

CPC ..... *A45D 34/00* (2013.01); *B65D 83/682* (2013.01); *A45D 2200/058* (2013.01); *B65D 83/62* (2013.01)

(58) Field of Classification Search

CPC ..... A45D 34/00; A45D 2200/058; B65D 83/682; B65D 83/62

USPC ..... 383/24

See application file for complete search history.

(56) References Cited

U.S. PATENT DOCUMENTS 177,749 A * 5/1876 Redden ..... B65D 33/2591 383/36
2,798,522 A * 7/1957 Hurt ..... A61F 7/08 383/36
3,112,047 A * 11/1963 Weinreich ..... B65D 77/065 222/105
3,194,185 A * 7/1965 Spinosa ..... A21C 1/006 426/556
3,597,770 A * 8/1971 Jacuzzi ..... A61G 9/006 4/144.2
3,797,734 A * 3/1974 Fleury ..... A61J 19/00 383/36
3,860,219 A 1/1975 Nickerson, Jr.
4,057,047 A 11/1977 Gossett
4,315,535 A * 2/1982 Battle ..... B60J 11/00 150/166
4,470,703 A 9/1984 Nickerson, Jr.
4,686,814 A * 8/1987 Yanase ..... B65D 33/20 383/35
5,030,013 A * 7/1991 Kramer ..... A45C 11/22 383/36

(Continued)

*Primary Examiner* — Peter N Helvey
(74) *Attorney, Agent, or Firm* — Dunlap Bennett & Ludwig, PLLC; Brendan E. Squire

(57) ABSTRACT

A method and apparatus for mixing beauty products, such as clay. The apparatus includes a flexible containment vessel, having a wide top opening, a throat constriction, and a bottom containment and mixing region. The throat constriction may be folded over to provide a sealing closure to prevent drying of the clay or spoilage between uses. The interior of the vessel is formed of a smooth rubberized material while the exterior has a textured surface to provide a frictional gripping surface to facilitate mixing of the beauty product within the vessel. A carrying handle and a hanging hook may also be included to facilitate mixing and storage of the containment and mixing vessel.

11 Claims, 3 Drawing Sheets

(56) References Cited

U.S. PATENT DOCUMENTS

| | | | | |
|---|---|---|---|---|
| 5,356,398 | A * | 10/1994 | Willis | A61G 9/006 383/63 |
| 5,618,105 | A | 4/1997 | Baker | |
| 5,709,467 | A | 1/1998 | Galliano, II | |
| 5,745,926 | A * | 5/1998 | Cailleteau | A61F 5/44 383/44 |
| 6,298,984 | B1 | 10/2001 | Weaver et al. | |
| 6,547,064 | B2 | 4/2003 | Klair | |
| 6,817,470 | B1 * | 11/2004 | Goldberg | H01H 9/0242 150/165 |
| 6,953,277 | B2 | 10/2005 | Karslake et al. | |
| 7,527,430 | B2 * | 5/2009 | Suskind | B65D 33/06 190/103 |
| 7,530,121 | B2 * | 5/2009 | Snider | A47K 11/12 4/144.1 |
| 8,104,960 | B2 * | 1/2012 | Gill | B65F 1/0006 383/36 |
| 8,500,708 | B2 * | 8/2013 | Glenn | A61G 9/006 4/144.1 |
| 9,220,334 | B1 | 12/2015 | Dodgen | |
| 9,533,819 | B2 | 1/2017 | Konno et al. | |
| 9,624,017 | B2 | 4/2017 | Kruse et al. | |
| 2002/0076471 | A1 | 6/2002 | Olsson | |
| 2006/0248660 | A1 | 11/2006 | Ryan et al. | |
| 2012/0269966 | A1 | 10/2012 | Ureta-Morales et al. | |
| 2012/0308164 | A1 * | 12/2012 | Hudson | A45F 5/00 383/98 |
| 2013/0230260 | A1 | 9/2013 | Maynard et al. | |

* cited by examiner

METHOD AND APPARATUS FOR MIXING BEAUTY PRODUCTS

CROSS-REFERENCE TO RELATED APPLICATION

This application claims the benefit of priority of U.S. provisional application No. 62/703,598, filed Jul. 26, 2018, the contents of which are herein incorporated by reference.

BACKGROUND OF THE INVENTION

The present invention relates to beauty products, and more particularly to mixing vessels for such products.

Clay is often utilized as a beauty or hair care product. However, the process of mixing clay (and other beauty products, such as henna) is messy and time-consuming. Care must also be exercised in the selection of a mixing vessel for these products. For example, mixing clay using a metal bowl or metal spoon will reduce or eliminate the effectiveness of the clay. Applying the clay to one's hair of skin can be cumbersome and may drip on the floor.

Likewise, once the clay is mixed, it must be properly stored between uses. For example, if hydrated clay is not stored properly it may dry out or it may mold. For this reason, small batches of clay are usually prepared because the clay cannot be stored for long periods; necessitating the user makes frequent batches reduce waste.

As can be seen, there is a need for an improved method and apparatus for mixing, storing and dispensing beauty products.

SUMMARY OF THE INVENTION

In one aspect of the present invention a mixing bag for beauty products, is disclosed. The mixing bag includes a flexible front panel and a flexible back panel joined along a peripheral edge surface. A constriction in the peripheral edge surface is interposed between a throat opening at a top end and a mixing chamber at a lower end. A loop is attached to at least one of the flexible front panel and the flexible back panel proximal to the constriction, such that when suspended by the loop, the throat opening folds transversely along the constriction to close the mixing chamber.

In some embodiments, each of the front panel and the back panel have an exterior fabric layer and an interior rubberized layer. In some embodiments the exterior fabric layer is a polyurethane laminate material.

In other embodiments, the loop is aligned transversely across the constriction. A web material may be attached about the throat opening. Preferably, the web material is attached around the peripheral edge surface of the panels.

In yet other embodiments, the mixing bag may also include an S-hook coupled to the loop.

In other aspects of the invention, a mixing bag for hydrating a beauty product is disclosed. The mixing bag includes a flexible bag formed from an outer fabric layer and an interior rubberized layer. A throat opening is defined at a top end of the bag. A mixing chamber is defined at a bottom end of the bag. A constriction is interposed between the throat opening and the top opening, the constriction partially containing the beauty product in the mixing chamber.

In other embodiments, a loop is attached to at least one face of the flexible bag within the constriction, such that when suspended by the loop, the throat opening folds across the constriction to provide a closure for the mixing chamber.

In another embodiment, a web material attached around the throat opening. In yet another embodiment, the web material is attached around a peripheral edge surface of the mixing bag.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provide an apparatus and method that allows for a beauty product, such as clay, to be mixed in a bag, which make the mixing process less messy and eliminates the chance of being in contact with metal. The mixing bag will allow for clay to be stored in the same container the clay was mixed. The unique aspects of the mixing bag 10 of the present invention prevents the clay from drying or molding for at least 11 months.

Figure 1:
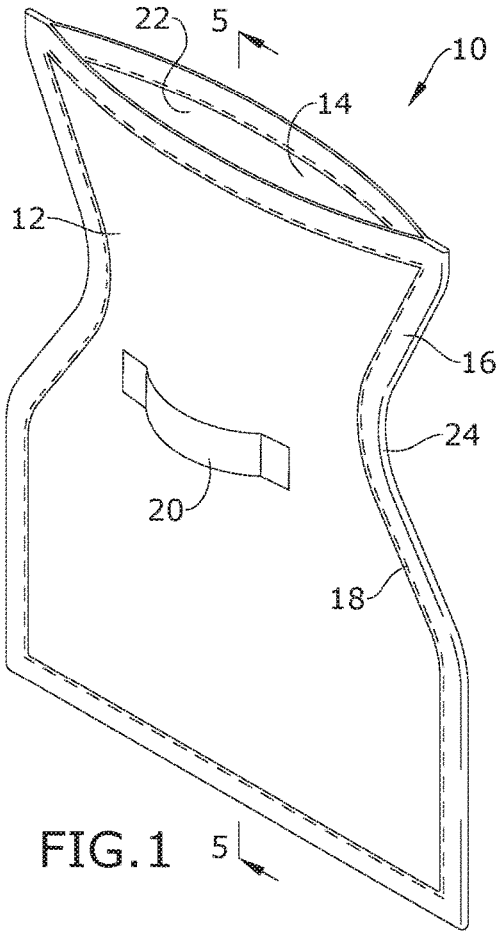
FIG. 1 is a front perspective view of the mixing bag, shown in an unfolded, open position.
Figure 2:
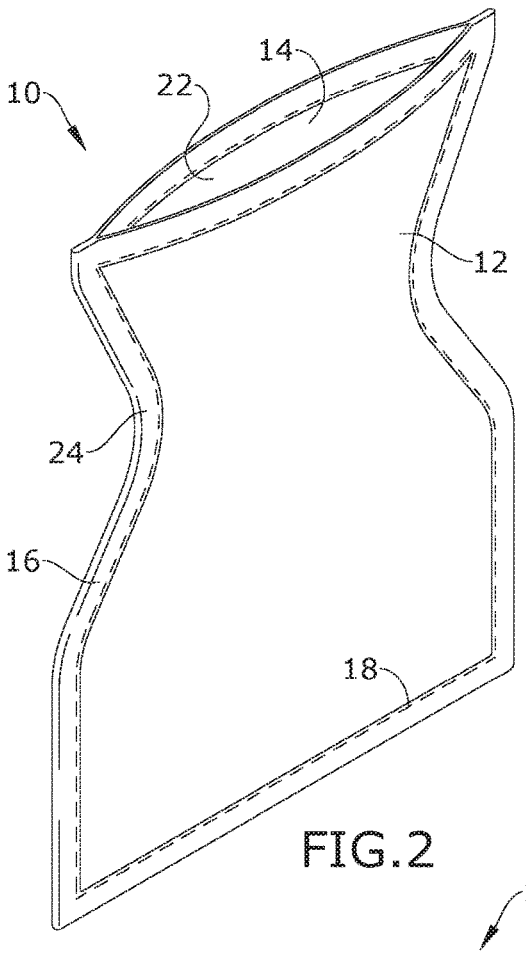
FIG. 2 is a rear perspective view of the mixing bag, shown in an unfolded, open position.
Figure 3:
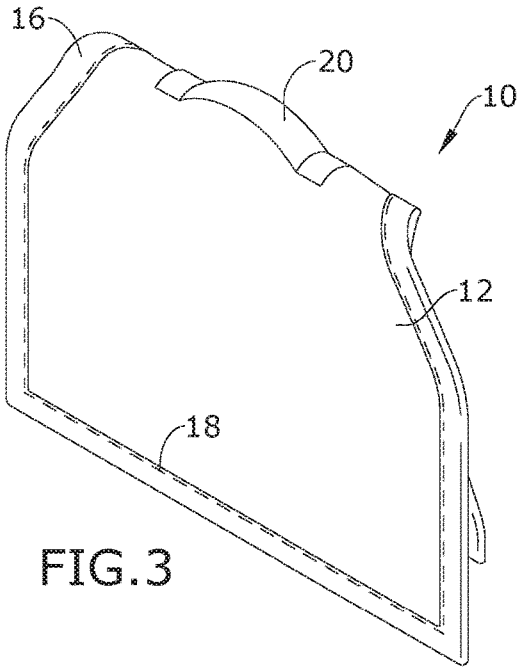
FIG. 3 is a front perspective view of the mixing bag, shown in an folded, closed position.
Figure 4:
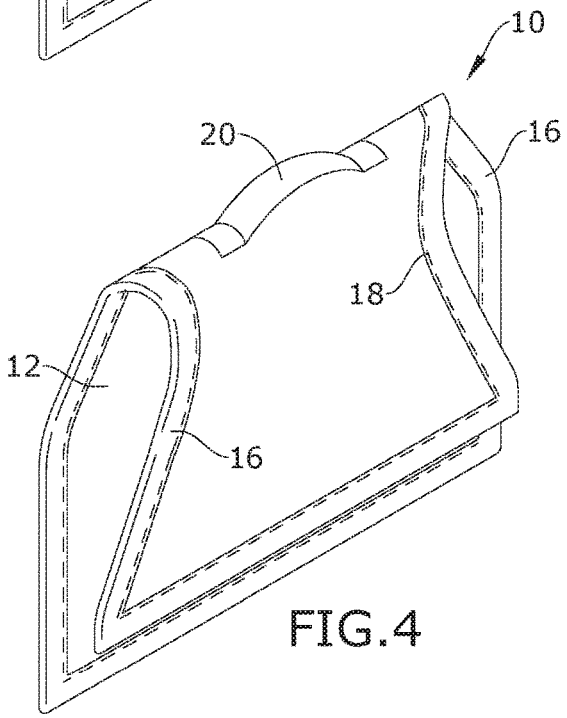
FIG. 4 is a rear perspective view of the mixing bag, shown in an folded, closed position.
Figure 5:
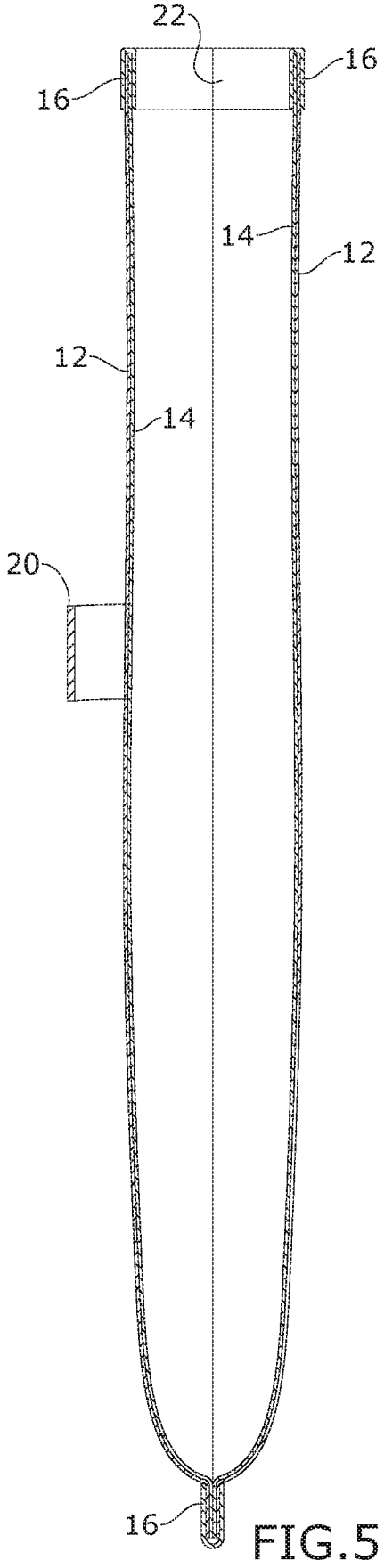
FIG. 5 is a section view of the mixing bag, taken along line 5-5 in FIG. 1.
Figure 6:
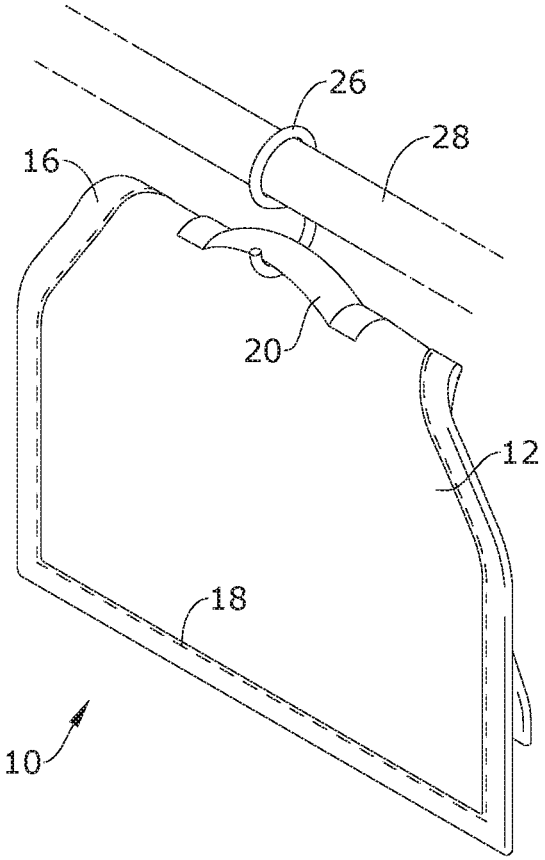
FIG. 6 is a front perspective view of the mixing bag, shown in a hung position using hook 26.
Figure 7:
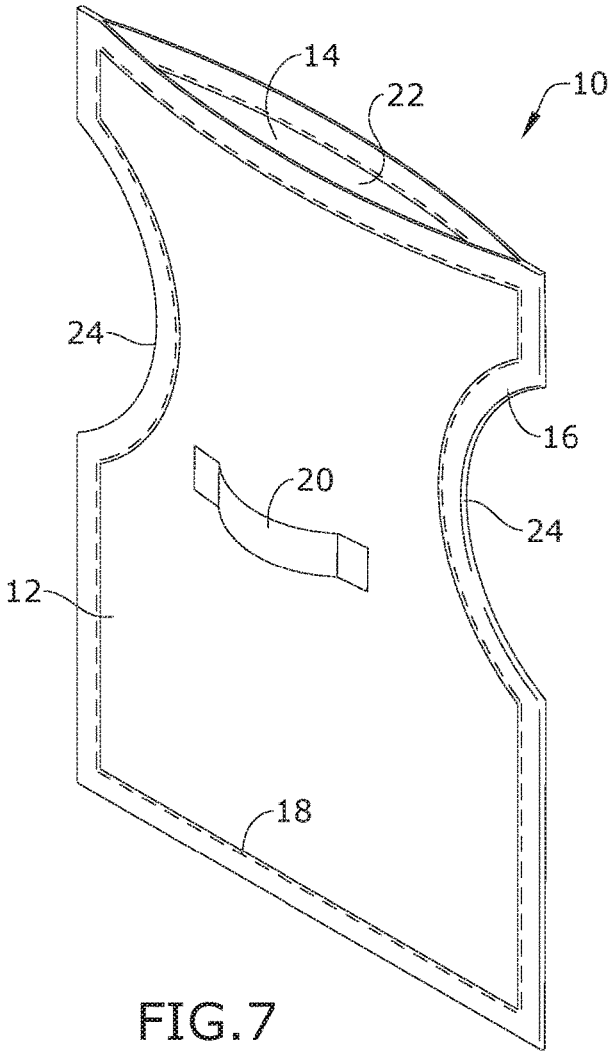
FIG. 7 is a perspective view of an alternate embodiment of the mixing bag, shown in an unfolded, open position.
Figure 8:
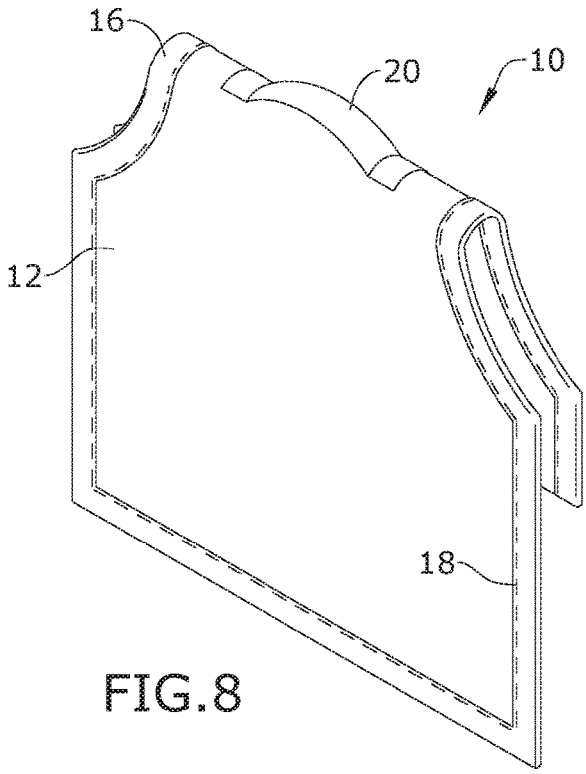
FIG. 8 is a perspective view of an alternate embodiment of the mixing bag, shown in an folded, closed position.

As seen in reference to the drawings of FIGS. 1-8, embodiments of the mixing bag 10 are illustrated. The mixing bag 10 may include a water proof, flexible rubber material as an interior layer 14 that allows the clay to be mixed well due to a smooth surface of the interior layer 14. The exterior of the bag 12 may include a water resistant polyurethane laminate (PUL) fabric. The PUL fabric is preferably both water and stain resistant that will dry fast on the exterior 12 of the mixing bag 10.

A webbing material 16, such as a herringbone polyurethane webbing material, is disposed about a throat opening 22 located at a top end of the mixing bag 10. In some embodiments, the webbing material 16 is also provided about a peripheral edge of the bag 10 to for added strength and securement of the connecting sides of mixing bag 10. A thread, such as nylon bonded thread, may be used as a stitching 18 to hold the interior layer 14 and exterior layer 12 together and reduce leakage. The mixing bag 10 may also include at least one carrying handle 20 to suspend the mixing bag 10 when not in use. A vinyl covered steel s-hook 26 may also be shaped to allow for the mixing bag 10 to hang on most shower rods, bars or structures in a shower area.

While the PUL material provides a flexible and resilient mixing container 10, it also provides a gripping surface to the exterior 12 to aid in the mixing and resistance to water and other substances. The body of the mixing bag 10 may be comprised of a vase shape with a constriction of the side edges below the throat to allow for the substance to be mixed to enter to the wide spout opening 22 easily and continue to a bulb shape lower section to hold hydrated clay and other mixtures.

The loop 20, or carrying handle, may be attached to the mixing bag 10 in a precise location and mounted transversely across the constriction 24 to allow for a fold across the constriction 24 so that the throat 22 of mixing bag 10 is automatically closed when the mixing bag 10 is suspended by the loop 20. The nylon covered water resistance hook 26 is shaped to hang from either end of the hook 26 and attached to mixing bag 10 carrying handle 22. The nylon 26 hook allows the hook to slide into the loop easy and is strong enough to hold more weight than the mixing bag 10 will ever become. Also the nylon material reduces the hook from sliding on a metal surface.

In use, the interior layer 14 of the mixing bag 10 is constructed of a soft and flexible rubber that is very smooth to avoid adhesion of the mixed clay to the interior surface of the mixing bag 10. The throat opening 22 of the mixing bag 10 bag is dimensioned to a size that will allow the mixing bag 10 to be turned inside out for easy cleaning.

In use, the smooth rubber surface allows the clay to be mixed easily, completely and quickly. The constricted vase shape of the mixing bag 10 will allow ingredients to enter the mixing bag 10 and not come out easily after entering the mixing bag 10 due to the constriction 24 at a middle section of the mixing bag 10.

As will be appreciated, the hook 26 also allows the mixing bag 10 to be hung while mixing, giving the user freedom to mix the ingredients or to squeeze hydrated mixture out of the mixing bag 10 with both hands.

The interior 14 and exterior 12 materials may be cut using a Lexan base die with a steel rule that has two punches indicators for placement of the webbing loop for consistency. The material may be die cut to make an a front section of PUL material exterior 12 and the interior 14 of a rubber material. Likewise, a back section of PUL material exterior 12 and rubber material interior 14. The front and back sections are joined with their interior layers 14 facing each other, and a fold is provided along a bottom edge. The loop strap 40 may be sewn to an exterior 14 of at least one of the sections near the constriction 24 between the bottom fold and the throat opening 22. The two sections of PUL and rubber materials are folded and are sewn together with stitching 18 on two sides leaving the throat 22 open and a fold at the bottom.

The loop 20 is placed in a position to make the mixing bag 10 hang to look like a small purse. The placement of the loop strap 20 will make a fold to assist in keeping the hydrated ingredients moist. The loop 20 should protrude a sufficient length for the nylon hook to slide through or to be grasped by the user's fingers.

The size and shape of the mixing bag 10 can be changed to allow for less mixture or more mixture as well as allow for a complete closure at the top. There is the ability to add another opening on the side or bottom to allow for a spout to dispense the hydrated mixtures. The loop 20 can be made to allow a suction cup to secure the mixing bag 10 on a wall and add more places to hang the mixing bag 10.

Application of clay for the hair and skin, can be applied in the shower where cleanup is easy. The mixing bag 10 according to aspects of the invention can store at least 11 months and more of usable hydrated clay to reduce the frequency of the mixing process. The mixing bag may be utilized to mix clays or other beauty products, like henna. The mixtures will be used for beauty purposes or a dye for the user's hair.

It should be understood, of course, that the foregoing relates to exemplary embodiments of the invention and that modifications may be made without departing from the spirit and scope of the invention as set forth in the following claims.

What is claimed is:

1. A mixing bag for beauty products, comprising:

a flexible front panel and a flexible back panel joined by a stitch along a peripheral edge surface, each of the front panel and the back panel have an exterior fabric layer and an interior rubberized layer, wherein the exterior fabric layer has a gripping surface to facilitate manipulation of the mixing bag when mixing the beauty products;

a constriction in the peripheral edge surface interposed between a throat opening at the top end and a mixing chamber at a lower end; and a loop attached to at least one of the flexible front panel and the flexible back panel proximal to the constriction, such that when suspended by the loop, the throat opening folds transversely along the constriction to close the mixing chamber.

2. The mixing bag of claim 1, wherein each of the front panel and the back panel have an exterior fabric layer and an interior rubberized layer.

3. The mixing bag of claim 2, wherein the exterior fabric layer is a polyurethane laminate material.

4. The mixing bag of claim 3, wherein the loop is aligned transversely across the constriction.

5. The mixing bag of claim 4, further comprising:

a web material attached about the throat opening.

6. The mixing bag of claim 5, further comprising:

a web material attached around the peripheral edge surface.

7. The mixing bag of claim 1, further comprising:

an S-hook coupled to the loop.

8. A mixing bag for hydrating a beauty product, comprising:

a flexible bag formed from an outer fabric layer and an interior rubberized layer, the outer layer having a gripping surface to facilitate digital manipulation of the mixing bag when mixing the beauty products therein;

a throat opening at a top end of the bag;

a mixing chamber at a bottom end of the bag;

a constriction interposed between the throat opening and the top opening, the constriction containing the beauty product in the mixing chamber; and a handle disposed transversely across the constriction, such that, when suspended by the handle, the top end of the bag is suspended in a folded condition across the constriction to retain the beauty product in the mixing chamber.

9. The mixing bag of claim 8, further comprising:

a loop attached to at least one face of the flexible bag within the constriction, such that when suspended by the loop, the throat opening folds across the constriction to provide a closure for the mixing chamber.

10. The mixing bag of claim 9, further comprising:

a web material attached around the throat opening.

11. The mixing bag of claim 10, wherein the web material is attached around a peripheral edge surface of the mixing bag.

* * * * *